US005123262A

United States Patent [19]

Laude-Bousquet

[11] Patent Number: 5,123,262

[45] Date of Patent: Jun. 23, 1992

[54] COLD TRANSFER METHOD AND DEVICE

[75] Inventor: Adrien Laude-Bousquet, Anse, France

[73] Assignee: Thermique Generale Et Vinicole, France

[21] Appl. No.: 611,674

[22] Filed: Nov. 13, 1990

[30] Foreign Application Priority Data

Nov. 10, 1989 [FR] France ..... 89 15278

[51] Int. Cl.[5] ..... E03B 7/12

[52] U.S. Cl. ..... 62/434; 62/332; 62/460; 137/59; 237/80

[58] Field of Search ..... 62/434, 460, 461, 332, 62/333; 237/80; 137/59; 138/27, 32

[56] References Cited

U.S. PATENT DOCUMENTS

| | | | |
|---|---|---|---|
| 291,161 | 1/1884 | Dankhoff | 62/460 |
| 758,436 | 4/1904 | Gold | 237/80 |
| 987,570 | 3/1911 | Gold | 237/80 |
| 1,014,833 | 1/1912 | Marshall | 62/434 |
| 1,589,281 | 6/1926 | Wittenmeier | 62/434 |
| 3,247,678 | 4/1966 | Mohlman | 62/199 |
| 3,396,752 | 8/1968 | Strout et al. | 138/27 |
| 3,757,531 | 9/1973 | Gement, Jr. | 62/156 |
| 3,869,870 | 3/1975 | Kuehner | 62/114 |
| 3,906,742 | 9/1975 | Newton | 62/332 |
| 4,336,792 | 6/1982 | Seiler | 237/80 |
| 4,509,344 | 4/1985 | Ludwigsen et al. | 62/76 |

FOREIGN PATENT DOCUMENTS

| | | | |
|---|---|---|---|
| 0262688 | 12/1988 | German Democratic Rep. | 137/59 |
| WO86/02374 | 4/1986 | PCT Int'l Appl. . | |

*Primary Examiner*—Albert J. Makay
*Assistant Examiner*—William C. Doerrler
*Attorney, Agent, or Firm*—Oliff & Berridge

[57] ABSTRACT

The present invention relates to a method and device for cold transfer. According to the invention, in an intermediate loop (2) a cold-bearing fluid being in diphasic form, that is, a homogeneous mixture of water and ice, for example. This fluid is heat exchanged, on the one hand with a primary source of cold, and on the other hand with the various secondary sources of heat represented by each enclosure (1) to be cooled. the invention is adaptable to the thermal control of a vinification process.

22 Claims, 4 Drawing Sheets

COLD TRANSFER METHOD AND DEVICE

BACKGROUND OF THE INVENTION

The present invention relates to the transfer or distribution of cold in a plurality of enclosures to be cooled, from a single and same intermediate cold-bearing fluid which is itself cooled by heat exchange with a unique refrigerating source.

The term "enclosure" is understood generally to refer to any heat source, that is to say any environment likely to be affected directly or indirectly by heat. It can be a substantially closed enclosure, such as a cool room, a premises for industrial or domestic use to be air conditioned, such as a dwelling house. It can also be an environment to be cooled contained in a recipient or a said enclosure, such as a liquid or fluid load; in this respect, in order to describe the present invention by way of example, reference will be made to the vinification field and more precisely to the cooling of fermentation vats, in order to control or thermally master this biological process.

According to U.S. Pat. No. 3,247,678, a cold transfer method such as mentioned above has been described for conditioning the air in several premises or separate enclosures. According to this method:

an essentially closed circuit is established, for the intermediate circulation of a cold-bearing fluid, namely a brine this fluid is cooled by a direct heat exchange between the cold-bearing fluid in liquid form and a refrigerating fluid, also in liquid form, butane in this instance for each enclosure to be cooled, partial current of the cold-bearing fluid is tapped from the intermediate circulation circuit, the environment to be cooled in the enclosure is cooled by heat exchange with the tapped partial current, and the reheated partial current is returned into the intermediate circulation circuit, downstream from the tapping of the latter partial current taken from the cold-bearing fluid, in the direction of the circulation of the latter.

According to this method, the cooling power supplied by the refrigerating fluid, with respect to the total cooling power consumed in the plurality of enclosures to be cooled, is adjusted in such a way as to have a cold-bearing fluid in circulation comprising two phases of water in melting equilibrium, in this instance brine and ice, mixed with each other homogeneously, and this being the case at least in the section of the circulation circuit from which the partial cooling currents are tapped or injected.

Such a cooling method has several disadvantages.

Firstly, each tapped circuit provides the circulation of a partial current of the diphasic cold-bearing fluid, of relatively low flow rate, towards the enclosure to be cooled. Experience shows that under these conditions ice crystals are likely to agglomerate and lead to complete obstruction of each tapped circuit, in particular in functioning periods where the cooling power supplied can temporarily exceed the total cooling power consumed. Such an obstruction can also result in the deterioration of the units for the circulation or control of the tapped partial current flow rate, such as pumps, valves, etc.

Then, the cooling power being able to be transferred per unit volume of cold-bearing fluid circulating in the intermediate circuit appears limited since, finally, a portion of the cold transferred to the various enclosures results in the reheating of the brine; the cold-bearing fluid in fact arrives in the reheated liquid state at the intake of the circulation pump.

Finally, the return of each tapped circuit, downstream from the tapping of the latter tapped circuit on the intermediate circulation circuit, reduces the flow rate available for the following tapped circuits, and therefore the negative kilo-calories available for the cooling of the following enclosures. There is therefore a kind of progressive exhaustion of the available cold, in the direction of circulation of the cold-bearing fluid. Furthermore, this tapping method results, in the branch of the intermediate circuit supplying the various tapped circuits, in a cold-bearing fluid flow rate which is much lower downstream of the various tapping points than upstream of the latter. This lower flow rate increases the risk of obstruction of the intermediate circuit itself, by the gain in mass of the different particles of the solid phase of the cold-bearing fluid.

The present invention aims at overcoming all these disadvantages.

SUMMARY OF THE INVENTION

The subject of the present invention is a method and a device, of the preceding type, allowing the availability of a maximum of cold per unit volume of cold-bearing fluid in circulation, due to the absorption of latent heat of melting of the said fluid, over practically the entire path of the intermediate circuit of the said fluid in the diphasic state.

Another subject of the invention is a method and a device allowing a circulation of the cold-bearing fluid, without obstruction by the solid phase of the said fluid, in each tapped circuit, but also in all parts of the intermediate circuit.

Another subject of the invention is a method and device ensuring a regular distribution of the negative kilo-calories available in the cold-bearing fluid, in all of the tapped circuits of the partial flows of the said fluid.

According to the invention and in combination:

a) the intermediate circulation circuit consists in a free flowing loop for carrying the cold-bearing fluid, that is to say a loop without interruption or passage of the fluid through such and such a unit other than a circulation pump or a control valve, for example an intermediate storage capacity or a filter; and the cooling power supplied, the total cooling power consumed and the circulation flow rate in the loop are adjusted in such way as to obtain at all points of the loop a homogeneous diphasic state in melting equilibrium b) each partial current is tapped, solely on the liquid phase of the cold-bearing fluid in circulation in the loop; the reheated liquid partial current is returned into the same loop.

Preferably, in the direction of circulation of the cold-bearing fluid in the loop, each reheated partial liquid current is returned immediately downstream or upstream of the tapping of the same current, that is to say respectively upstream of the tapping of the next partial current on the same loop, or downstream from the return of the tapping of the preceding partial current.

Due to the choice according to the invention;

a current of relatively large flow rate of the cold-bearing fluid in the diphasic state circulates in the intermediate circuit each tapped circuit is fed by a tapping on the liquid phase of the cold-bearing fluid, the tapped and reheated partial current being returned beside the tapping or injection of the same tapped liquid current each reheated partial current, in the liquid state, reinjected in the intermediate circulation circuit, is immediately cooled, by the melting of the solid phase of the cold-bearing fluid, before the latter flows in part in the following tapped circuit or in the same tapped circuit.

In this way, for a relatively limited dimensioning of the intermediate circuit, particularly with regard to cross-section, it appears possible to carry a relatively large quantity of negative kilo-calories to the different enclosures to be cooled and for this to be carried out without obstruction of the different circuits, and with a balanced distribution of the negative kilo-calories to the different tapped circuits.

Preferably, the cold-bearing fluid comprises ice in pasty form, in melting equilibrium in water. Given that the ice floats on top of the water, turbulent conditions are established in the cold-bearing fluid in order to maintain its pasty form, with the dissolving of the ice.

BRIEF DESCRIPTION OF THE DRAWINGS

The present invention is now described with reference to the appended drawings in which.

DETAILED DESCRIPTION OF PREFERRED EMBODIMENTS

Figure 1:
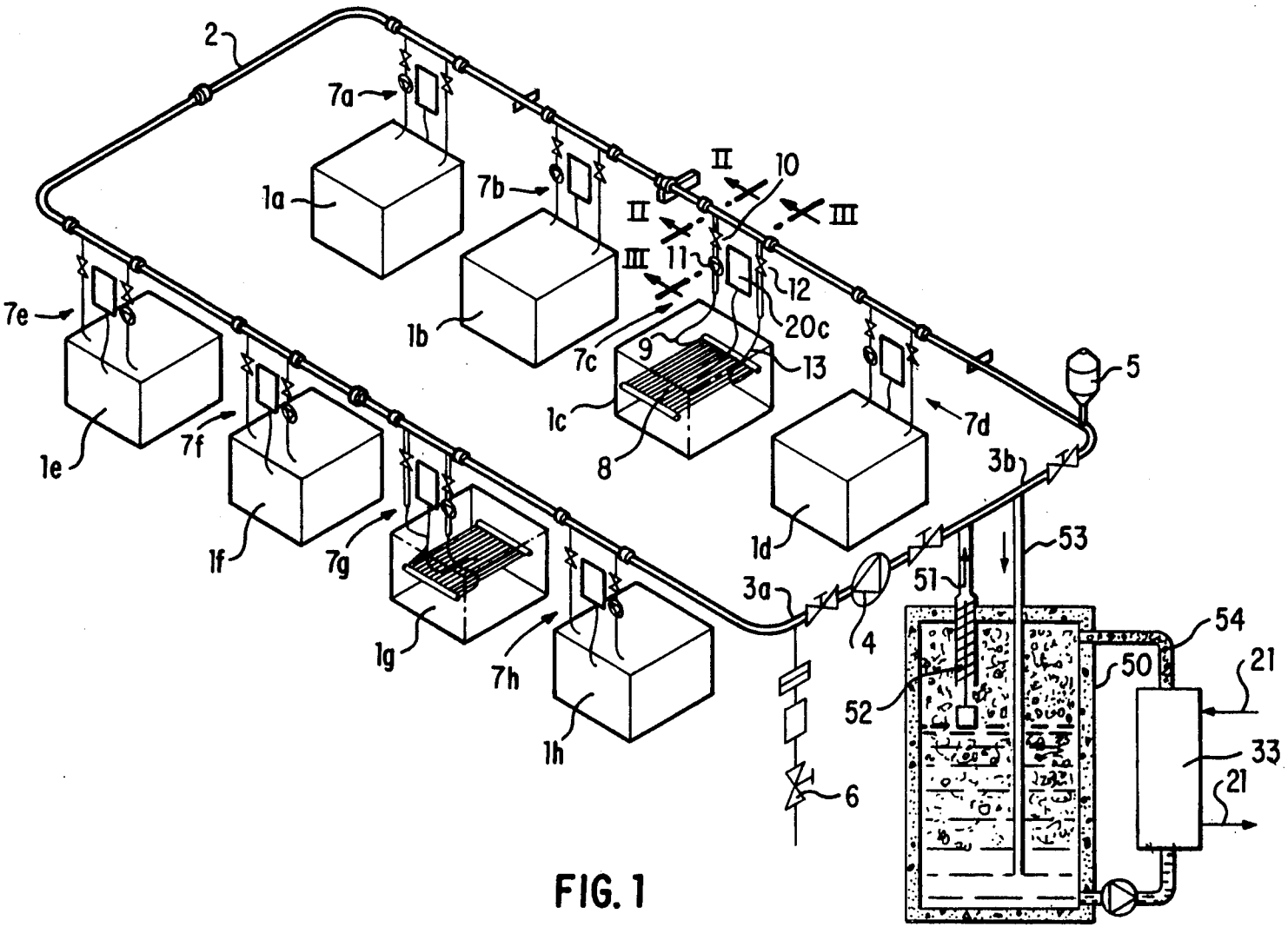
FIG. 1 shows a cold transfer installation or device according to the invention, in the framework of a vinicultural exploitation comprising a plurality of fermentation vats for a grape harvest

According to FIG. 1, a cold transfer installation according to the invention allows the cooling of a plurality of vats 1*a* to 1*h*, disposed in the same location, and containing in all or in some of them a load of grapes or a grape harvest in fermentation. The vats 1*c* and 1*g* have been shown in a detailed way in FIG. 1.

An intermediate circuit 2 allows the circulation of a cold-bearing fluid, namely diphasic water in melting equilibrium, these two phases being mixed with each other homogeneously, for example in the form of a paste or "sorbet", in which ice floats in a natural manner in the water. The circuit is in the form of a practically closed loop, whose outlet 3*b* is connected to the inlet of a pump 4, and whose inlet 3*a* is connected to the delivery outlet of the same circulation pump 4. Conventionally, the intermediate circuit 2 is fitted with an expansion chamber 5 and a filling valve 6 provided at its output with an anti-scale device and a filter.

This circuit 2 is practically closed to itself in the sense in that, apart from the tappings necessary for the withdrawal and supply of cold-bearing fluid, and of those corresponding to the inlet and outlet of each tapped circuit, there are no other inlets or outlets of the cold-bearing fluid, which rotates around the loop 2, in the homogeneous diphasic state, practically at all points of the loop.

In the loop 2, the cold-bearing fluid is freely carried, in the sense that there are no obstacles or devices, other than a pump 4 and the necessary control valves, through which the current of the said fluid passes and acting against the circulation or flux of the latter. Such devices could for example be a filter through which the entire flow of the cold-bearing fluid passes; according to the invention, such devices are excluded from the path or passage of the cold-bearing fluid in the loop.

Advantageously, the loop 2 can be produced by the assembly or fitting of pipes made from plastic material, for example PVC, connected with appropriate seals, for example so-called "tulip" elastomer seals.

In the intermediate loop 2 there is connected a thermally insulated tank 50 for the generation and storage of diphasic water in melting equilibrium. This tank or silo is connected to the loop 2 by means of an input duct 51 fitted with an endless screw 52 for feeding paste or "sorbet", on the intake side of the pump 4; this recipient is connected with the loop 2, by an output duct 53, with a tapping which is uniquely in the liquid phase of the cold-bearing fluid, upstream of the input duct 51. Internal means (not shown) for putting the water and the ice into state of turbulence are associated with the recipient 50. A tapping 54 takes water in liquid phase from the base of the recipient 50, and returns a mixture of ice and water to the top of the recipient 50. With this tapping there is associated a primary heat exchanger 33, with a polished surface, in which a refrigerating fluid 21 flows this fluid being part of a refrigeration unit.

Figure 2:
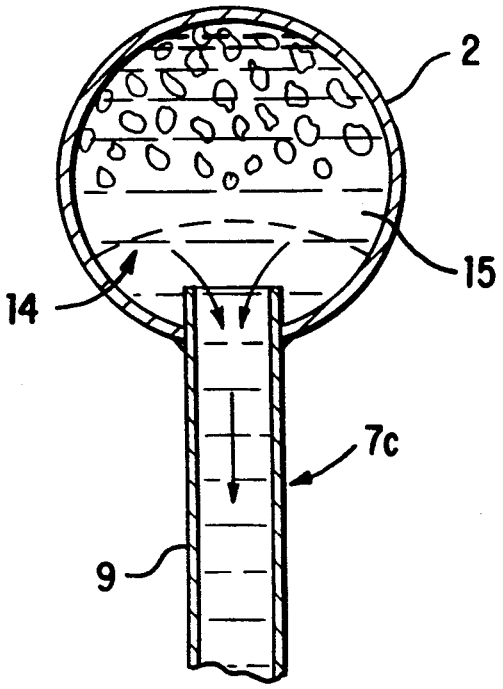
FIG. 2 shows, on an enlarged scale, a cross-sectional view of a liquid phase tapping of a tapped circuit, on the intermediate loop of the cold-bearing fluid

As shown for the vats 1*c* and 1*g*, each tapped circuit, for example 7*c*, associated with a vat, for example 1*c*, essentially comprises a secondary heat exchanger 8, disposed in the vat, either within the load in the process of fermentation, or at its surface. The inlet 9 of the exchanger 8 is connected to the intermediate loop 2 via a tapping controlled by a valve 10 and a pump 11. The outlet 13 of the same exchanger is connected to the intermediate loop 2, in the form a return tapping controlled by a valve 12. As shown in FIG. 2, the inlet 9 of each tapped circuit 7*c* is provided with a device, for example a grid 14, ensuring a tapping which is uniquely in the liquid phase of the cold-bearing fluid 15, shown in FIG. 2 and 3 in the form of a mixture of water and ice.

Figure 3:
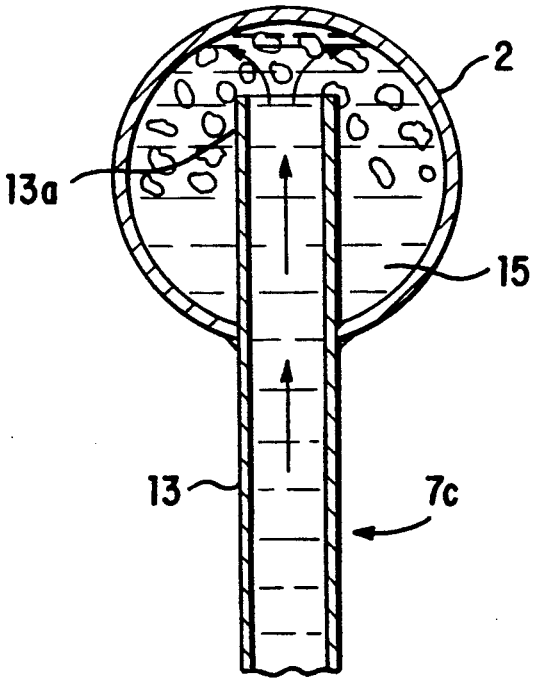
FIG. 3 shows, on an enlarged scale, a cross-sectional view of the return of the tapped partial current into the intermediate loop, from the same tapped circuit

According to FIG. 3, the downstream end 13*a* of each outlet duct 13 of a tapped circuit 7 opens into the upper section of the intermediate circulation loop 2, in such a way that the return of relatively warm water is carried out directly into the ice of the diphasic mixture.

Furthermore, as shown in vats 1*c* and 1*g*, a control system, for example 20*c*, is associated with each vat, and comprises a temperature detector (not shown) disposed on the heat exchanger 8, for example at its output, a device for adjusting the flow rate circulating in the tapped circuit, for example 7*c*, and an automatic means for the control of the same flow rate as a function of the temperature detected on the exchanger 8. The control system 20 can act either on the pump 11, or on one or other of the control valves 10 and 12.

By means of the previously described installation, it is possible to transfer cold into the different vats 1*a* to 1*h* to be cooled according to the following method:

in the circuit 2 there is established an intermediate circulation loop of the cold-bearing fluid, in diphasic form as previously mentioned, this fluid is cooled, and therefore permanently maintained in the diphasic form, outside of the loop 2, with production of ice in the silo 50, by heat exchange with the refrigerating fluid 21 circulating in the primary exchanger 33 at the level of each vat 1, in the corresponding tapped circuit 7, a current in liquid phase is tapped from the cold-bearing fluid, the load in the vat 1 is cooled by heat exchange, in the secondary exchanger 8, with the tapped current of the cold-bearing fluid; this exchange of heat causes the reheating of the liquid phase of the tapped current; and finally the reheated current is returned into the intermediate loop 2 in the latter, the returned tapped current is immediately cooled again to freezing temperature, by the melting of the solid phase present at that place in the intermediate loop.

As shown in FIG. 2, the current flowing in each tapping 7 associated with each vat is taken from the liquid phase of the cold-bearing fluid 15, that is to say from the water-ice, sorbet-type mixture.

Furthermore, by means of the control system 20 associated with each vat 1, the flow rate circulating in the tapping 7 is controlled, for each enclosure or vat 1, as a function of one or more measured or detected parameters. The first measured or detected parameter is the temperature of the tapping current 7 reheated or in the process of reheating in the exchanger 8. A second parameter can be the temperature in the vat 1. These two parameters allow the detection at all times of the quantity of heat released in the vat, during the fermentation phase. By analysis of the variation of any one of these temperatures it is thus possible to detect the real requirement of cold in the vat, and to anticipate or modulate the amount of refrigeration applied to the latter.

According to the invention, an intermediate loop 2 for the circulation of the cold-bearing fluid can be used in any type of configuration. According to FIG. 1, this configuration is situated on one and the same level, such that the cold-bearing fluid essentially circulates in the same horizontal plane. But according to FIGS. 4 and 5, the intermediate circulation loop 2 can be disposed in two levels, one being the upper level referenced 60 and the other being the lower level referenced 61. In this case, the connection arrangements between these two levels shown in FIGS. 4 and 5 allow:

the establishment in the drop towards the lower level 61 of a current of linear speed which is sufficiently large to carry with it the solid phase separated from the cold-bearing fluid, for example ice particles and the retention of the solid phase particles, at the level at which they are, in the case of stopping the installation, in particular in the case of stopping the circulation pump 4.

Figure 4:
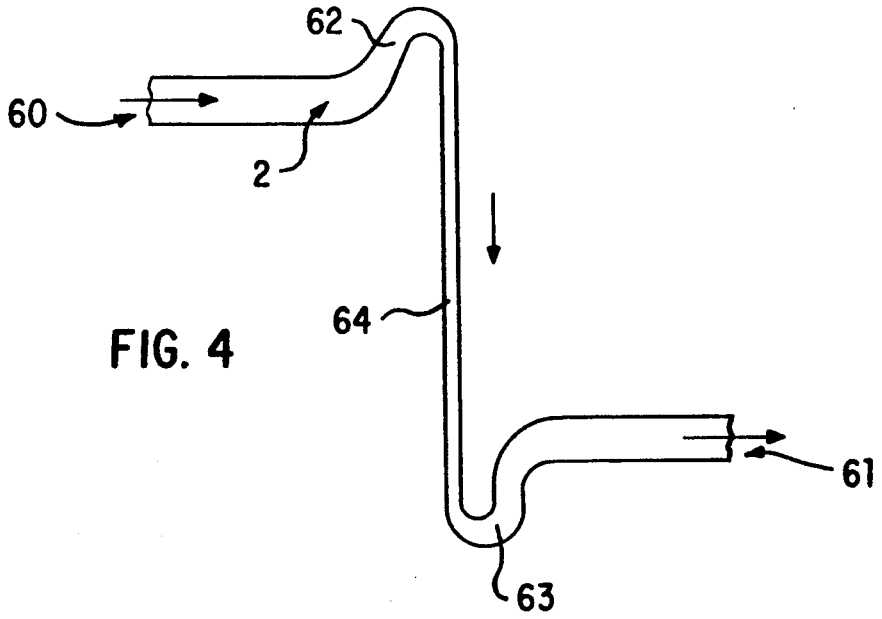
FIGS. 4 and 5 show two methods of connection between an upper level and a lower level of a same intermediate circulation loop.

For an intermediate circulation of the cold-bearing fluid, with a low solid phase content, for example of the order of 10 to 15% of the volume in circulation, according to the FIG. 4 the drop towards the lower level 61 is initiated, at the top, by an upward mounted syphon 62, and is completed, at the bottom, by a syphon 63, normally downward mounted. The cross-section of the inner vertical duct 64 dropping between the two syphons 62 and 63 is smaller than the nominal cross-section of the intermediate circulation loop 2, in order to increase the linear speed of descent of the cold-bearing fluid. Due to this arrangement, the solid phase accumulating little by little at the top of the syphon 62, becomes pushed into the vertical duct or column, by being carried along with the liquid phase of the cold-bearing fluid, acting as a flush. This same solid phase, in dispersed form, then passes through the second syphon 63 and is then found again at the lower level 61. The arrangement according to FIG. 4 therefore proves effective for avoiding any obstructing blockages of the solid phase of the cold-bearing fluid.

Figure 5:
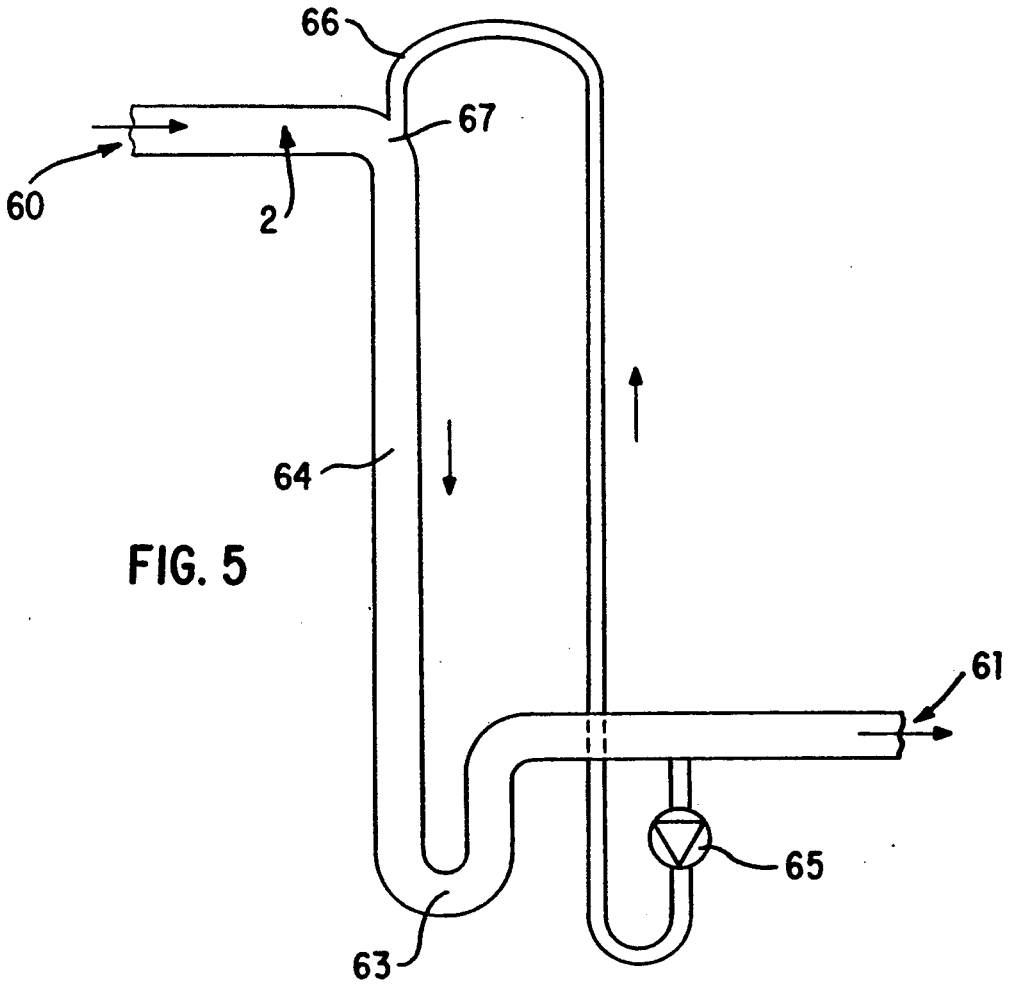

The arrangement according to FIG. 5 is used when the cold-bearing fluid in the intermediate loop 2 has a relatively high ice content, for example exceeding 10 to 15% of the total volume of the latter. According to this arrangement, the upper syphon 62 is eliminated, but the lower syphon 63 is retained. The drop to the lower level 61 is therefore initiated by a normal right-angled bend of the loop 2. Downstream of the syphon 63, a pump 65 takes a proportion of the cold-bearing fluid, in liquid form only, raises the flow thus taken to the upper level 60, and injects the raised flow into an orifice 66 provided in the bend 67, in the axis of the vertical drop duct 64, the latter having the nominal diameter of the circulation loop 2. In this way, an acceleration of the current of the cold-bearing fluid descending in the duct 64 is created. According to FIG. 5, in the case of stopping the installation, all of the solid phase of the cold-bearing fluid is again at the lower level 61, and remains there, because of the syphon 63. In this way, the creation of any major obstruction or blockage is avoided at the upper level 60 of the loop 2, which would prevent the restarting of the installation.

Figure 6:
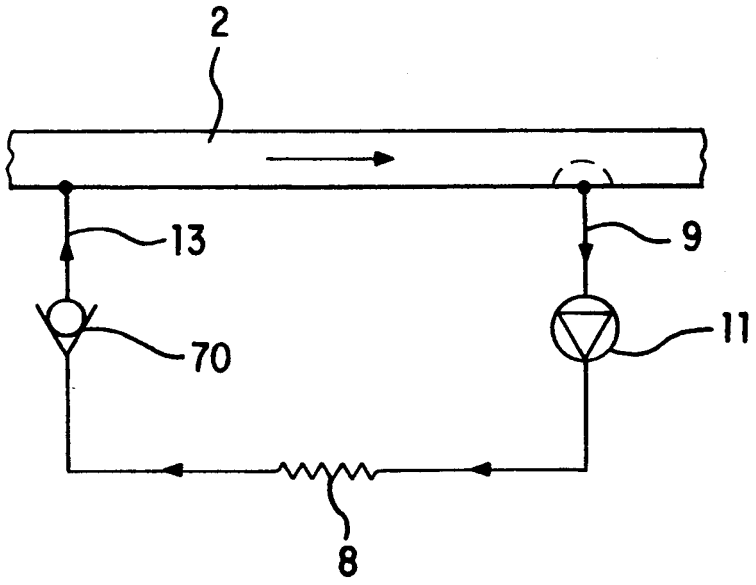
FIG. 6 shows another method of connecting a tapped circuit to the intermediate loop.

According to FIG. 6, the outlet tapping 13 of the tapped circuit is disposed upstream of the inlet tapping 9 of the same circuit, in the direction of circulation of the coldbearing fluid in the loop 2. A non-return valve 70 is disposed on the outlet 13 between the exchanger 8 and the return tapping. This arrangement avoids any circulation of the cold-bearing fluid in the case of stopping of the pump 11.

The present invention can be applied outside of the vinification field, for example it can be used in air conditioning or for refrigerated warehouses.

I claim:

1. A method of cooling at least one enclosure comprising the steps of:

circulating a diphasic mixture of the same substance in melting equilibrium in a main loop, said diphasic mixture comprising a liquid portion and a solid portion of said liquid in a frozen state;

diverting at least part of only said liquid portion to said at least one enclosure in a corresponding diverted loop such that said solid portion remains in said main loop;

transferring heat from said at least one enclosure to said liquid in said corresponding diverted loop;

returning said heated liquid in said corresponding diverted loop to said main loop; and regulating the flow and cooling of said diphasic mixture to maintain said mixture in a homogeneous state at substantially all points in the main loop.

2. The method of claim 1, wherein the heated liquid in the corresponding diverted loop is returned tot he main loop immediately upstream from the point on the main loop where the liquid is diverted.

3. The method of claim 1, wherein the heated liquid in the corresponding diverted loop is returned to the main loop immediately downstream from the point on the main loop where the liquid is diverted.

4. The method of claim 1, wherein the temperature of the diverted liquid is measured and the flow rate of the diverted liquid in the diverted loop is regulated based upon said measured temperature.

5. The method of claim 1, wherein the liquid portion and solid portion of said diphasic mixture are water and ice respectively.

6. The method of claim 1, wherein the at least one enclosure is a plurality of enclosures.

7. The method of claim 1, wherein after said step of returning said heated liquid in said corresponding diverted loop to said main loop, at least part of said liquid portion including at least part of said heated liquid is cooled by said solid phase of said diphasic mixture.

8. A cooling device comprising:

a main loop for transporting a diphasic mixture in melting equilibrium, said mixture comprising a liquid portion and a solid portion;

a primary heat exchanger in said main loop for cooling said diphasic mixture by indirect heat exchange with a refrigerating fluid different from the diphasic mixture;

at least one diverted loop having an inlet and an outlet connected to said main loop, said at least one diverted loop comprising a secondary heat exchanger; and means for ensuring that at least part of only said liquid portion is diverted to said diverted loop, said means for ensuring being at said connection between said inlet of said diverted loop and said main loop.

9. The device of claim 8, wherein said outlet of said diverted loop is connected to said main loop immediately downstream from said inlet of said diverted loop in the direction of flow of said diphasic mixture in said main loop.

10. The device of claim 8, wherein said at least one diverted loop comprises a plurality of diverted loops connected to said main loop wherein said outlet of one of said diverted loops is immediately upstream from said inlet of another one of said diverted loops in the direction of flow of said diphasic mixture in said main loop.

11. The device of claim 8, further comprising a tank in fluid communication with said primary heat exchanger for generating and storing said diphasic mixture, said tank being connected to said main loop by an inlet and an outlet.

12. The device of claim 8, wherein the main loop is disposed on at least two different levels with at least one corresponding substantially vertical duct between upper and lower said levels.

13. The device of claim 12, further comprising a lower syphon disposed between the bottom of said substantially vertical duct and said lower level of said main loop.

14. The device of claim 12, further comprising an upper syphon disposed between said upper level of said main loop and the top of said substantially vertical duct, said upper syphon having a smaller cross-section than the cross-section of said main loop.

15. The device of claim 13, further comprising a reinjection loop having an inlet connected to the main loop downstream of said lower syphon and said reinjection loop having an outlet connected at a bend between said upper level of said main loop and said substantially vertical duct, said reinjection loop inlet having a means for ensuring the passage of only a liquid portion of said diphasic mixture.

16. The device of claim 8 wherein the primary heat exchanger comprises a refrigerating fluid for cooling said diphasic mixture.

17. The device of claim 8, wherein said at least one diverted loop is a plurality of loops.

18. The device of claim 8, wherein said secondary heat exchanger is within an enclosure for cooling said enclosure.

19. The device of claim 8, further comprising means for regulating the flow rate and rate of cooling of said diphasic mixture to maintain the diphasic mixture in a homogeneous state.

20. The device of claim 8, further comprising a means for measuring the temperature of said liquid portion within said diverted loop, and means for regulating the flow rate of said diverted liquid portion based upon the temperature measured by said temperature measuring means.

21. The device of claim 8, wherein the liquid portion and solid portion of said diphasic mixture are water and ice respectively.

22. The method of claim 1, wherein the diphasic mixture is cooled by indirect heat exchange with a refrigerating fluid different from the diphasic mixture.

* * * * *